US008360349B1

(12) United States Patent
Sotsky

(10) Patent No.: US 8,360,349 B1
(45) Date of Patent: Jan. 29, 2013

(54) ROTARY GRINDER CONTROL SYSTEM AND METHOD

(75) Inventor: George R. Sotsky, Louisville, KY (US)

(73) Assignee: Republic Machines, Inc., Louisville, KY (US)

( * ) Notice: Subject to any disclaimer, the term of this patent is extended or adjusted under 35 U.S.C. 154(b) by 1715 days.

(21) Appl. No.: 10/456,122

(22) Filed: Jun. 6, 2003

(51) Int. Cl.
*B02C 23/00* (2006.01)
*B02C 4/32* (2006.01)

(52) U.S. Cl. ..... 241/33; 241/35; 241/36

(58) Field of Classification Search ..... 241/33–36
See application file for complete search history.

(56) References Cited

U.S. PATENT DOCUMENTS

| | | | | |
|---|---|---|---|---|
| 3,792,817 | A * | 2/1974 | Reilly | 241/30 |
| 4,804,148 | A * | 2/1989 | Etheridge | 241/35 |
| 4,844,363 | A * | 7/1989 | Garnier et al. | 241/224 |
| 4,865,094 | A * | 9/1989 | Stroud et al. | 144/176 |
| 6,405,662 | B1 * | 6/2002 | Williams et al. | 110/341 |
| 2002/0159327 | A1 * | 10/2002 | Proni et al. | 366/76.7 |
| 2005/0001083 | A1 * | 1/2005 | Cook et al. | 241/292.1 |

* cited by examiner

*Primary Examiner* — Bena Miller
(74) *Attorney, Agent, or Firm* — Middleton Reutlinger; Alexander P. Brackett

(57) ABSTRACT

The present invention relates to a control system for a rotary grinder. Rotary grinders control systems of the present invention are, for example, used to grind plastic or wood to reduce the size of the material to a desired size. Material to be ground is forced by an hydraulic ram toward a rotor having a plurality of cutters thereon. The control system is capable of controlling the grinding operation as a function of ram velocity and pressure as well as power consumption by the rotor.

6 Claims, 3 Drawing Sheets

ROTARY GRINDER CONTROL SYSTEM AND METHOD

BACKGROUND OF THE INVENTION

The present invention relates generally to a rotary grinder with an improved control system and more specifically to a control system capable of minimizing rotor over-current events while maximizing grinding efficiency for a rotary grinder having a rotor and a ram for feeding material into the rotor. Rotary grinders are used to grind a wide variety of materials including, but not limited to plastics, metals, woods, composite materials or rubber in various physical forms to reduce the size of the material to that suitable for further handling or processing. Material to be ground is usually placed inside a hopper which drops or feeds material into a space bounded by a ram at a first end and a rotor at a second end. The ram is then moved forward to force the material toward a driven rotor having a plurality of cutters (or teeth) thereon.

Furthermore, a grooved screen, or a plurality thereof, may be employed at an outlet proximate the rotor wherein each screen has a plurality of V-shaped grooves or like apertures therein through which the ground material passes once it is reduced in size such that it is capable of passing through the screen. Often several screens are provided for a given grinder, and the screen having the appropriate groove size is selected for use depending upon the material being ground. The screens are typically positioned proximate a discharge area below the rotor to allow ground material to exit the grinding process by dropping into a bin or like container for further processing.

The cutters travel in the screen grooves, thereby permitting the cutters to remove excess material from the screen so that ground material, for example, plastic, does not block the apertures therein. Material that is not reduced in size sufficiently to pass through the screen is simply re-ground until it passes through the grooves and into a collection bin or the like.

Rotary grinders that utilize driven rams to force feed material towards a rotor are known in the art. A compartment proximate the lower portion of the hopper of the grinder contains a pair of horizontal channels or grooves on opposed sides of the hopper. A horizontal ram, conventionally driven by a hydraulic cylinder and piston system, is forced forward to move the material to be ground toward the rotating rotor with its plurality of cutters.

A grinder operator initially monitors the progress of a given grinding operation to determine how quickly to move the ram forward in order to efficiently grind material and establishes parameters for the grinder operation, usually programmed (or selected) into a control computer via an operator interface. The ram moves forward (usually stopping and starting) and attempts to control the operation based upon a preselected motor amperage of the rotor during grinding. When the rotor becomes loaded down with too much material, the rotor motor can trip off due to blown fuses or thermal overloads. Furthermore, in many instances the material being ground may begin to melt due to the heat buildup involved. This problem is particularly acute when grinding various types of plastics, materials with low melting points, materials that tend to wrap themselves around the rotor, or materials with high coefficients of friction such as rubber. Often the result is partially melted plastic clogging the cutters and screen grooves, thereby drastically diminishing the cutting action of the rotor.

Even when such clogging doesn't occur, if the material is fed towards the rotor too quickly the rotor motor must work too hard to grind the material thus decreasing the working life of the cutters and the motor. In contradistinction, if the material is fed too slowly, the grinding operation uses more energy than necessary to efficiently grind the material or doesn't grind material at all, thereby reducing productivity and enhancing the time and expense of the grinding operation.

German patent reference no. 3,932,345 teaches a typical rotor and cutters. U.S. Pat. No. 4,844,363 teaches a non-horizontal moving hopper ram wherein the ram is guided by a pair of grooved tracks 49. U.S. Pat. Nos. 5,509,613 and 5,344,088 teach material grinders having a ram driven by a pair of pistons 24 from hydraulic cylinders 23. U.S. Pat. No. 5,645,234 teaches another grinder having a ram head.

SUMMARY OF THE INVENTION

The present invention is a control system and method for a rotary grinder having a rotating rotor and a ram for forcing material toward the rotor. Rotary grinders in accordance with the present invention are, for example, used to grind plastic or wood to reduce the size of the material to a desired size for further processing or recycling. In a typical grinding operation, the material to be ground is placed between the ram and the rotor, wherein the ram is then used to force the material toward the rotor which has a plurality of cutters (or teeth) thereon. Further, a screen is often employed wherein the screen has a plurality of grooves or like apertures therein in which the cutters travel. This permits the cutters to "clean" the screen as the rotor rotates so that ground material does not block the openings in the screen.

The rotor is typically driven by a conventional reversible electric motor controlled via a motor control center having a contactor mounted therein, or an equivalent power distribution mechanism as is known to one of ordinary skill in the art. The ram is driven by an hydraulic cylinder and piston that moves the ram forwards towards the rotor, or backwards away therefrom.

The grinder control system of the present invention utilizes a central computer control that eliminates rotor over-current events by sensing the current being supplied to the rotor and adjusting the rotor direction and/or the ram speed and direction based upon the work being accomplished by the rotor. The present system allows the grinder to avoid overheating the rotor motor and the material being ground thereby averting costly and time-consuming clogs and machine shutdowns and further permits the maximization of grinder productivity by allowing an operator to program or select a plurality of parameters depending upon the material being ground.

Therefore, one object of the invention is a grinder control system that eliminates or minimizes rotor over-current events.

A further object of the invention is a grinder control system that monitors the power being supplied to the grinder rotor to anticipate motor over-current events.

A further object of the invention is a grinder control system that enhances grinding efficiency.

A further object of the invention is a grinder control system that monitors and limits the force used by a ram to push material into the rotor.

A further object of the invention is a grinder control system that controls ram speed based upon operator input to efficiently grind material.

A yet further object of the invention is a grinder control system that allows customization by an operator depending upon the physical characteristics of the material being ground.

Further objects of the present invention will become apparent from the detailed description of the preferred embodiments taken in conjunction with the drawing figures.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT(S)

Figure 1:
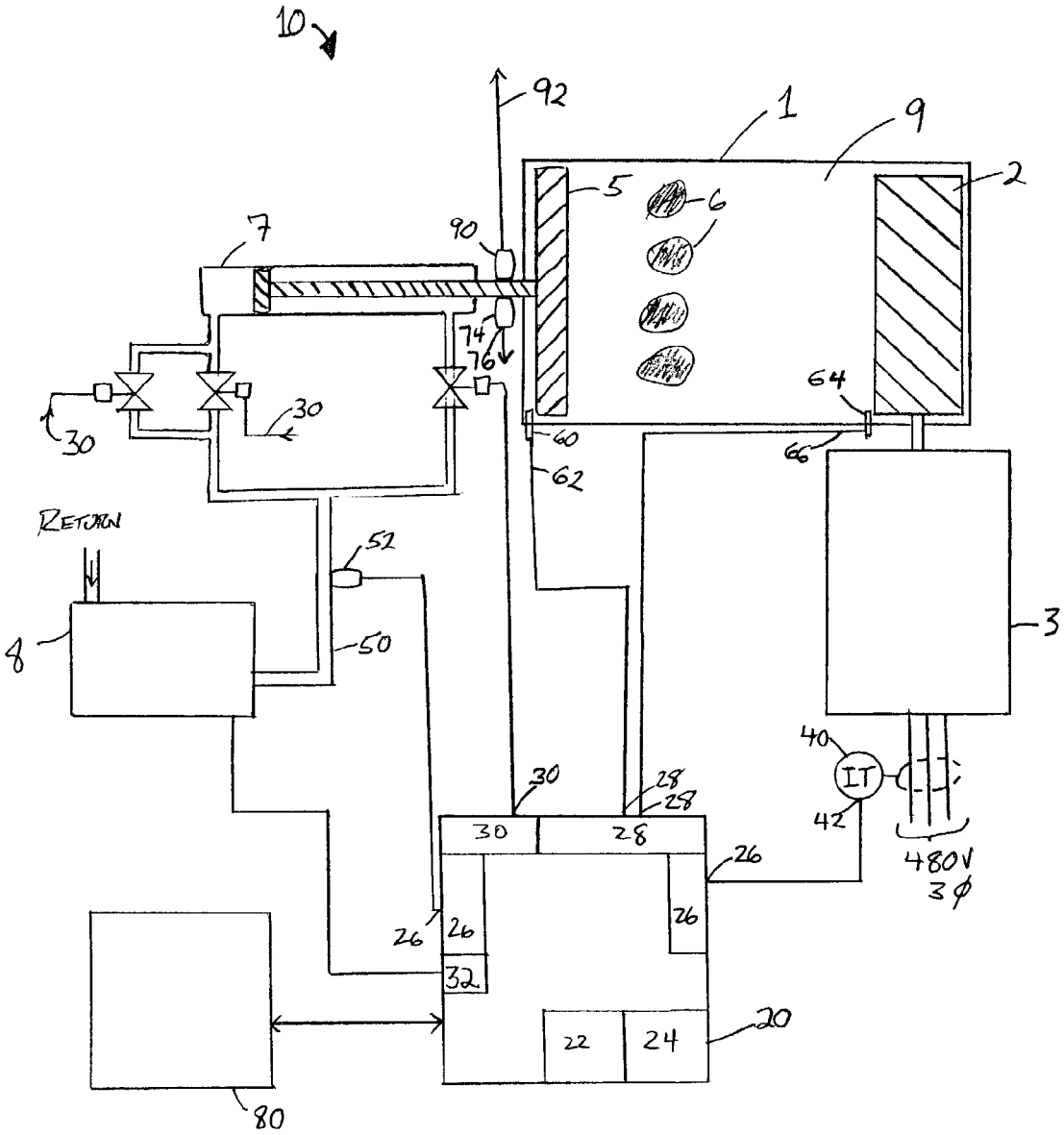
FIG. 1 is a block diagram of a rotary grinder control system in accordance with the invention.
Figure 2:
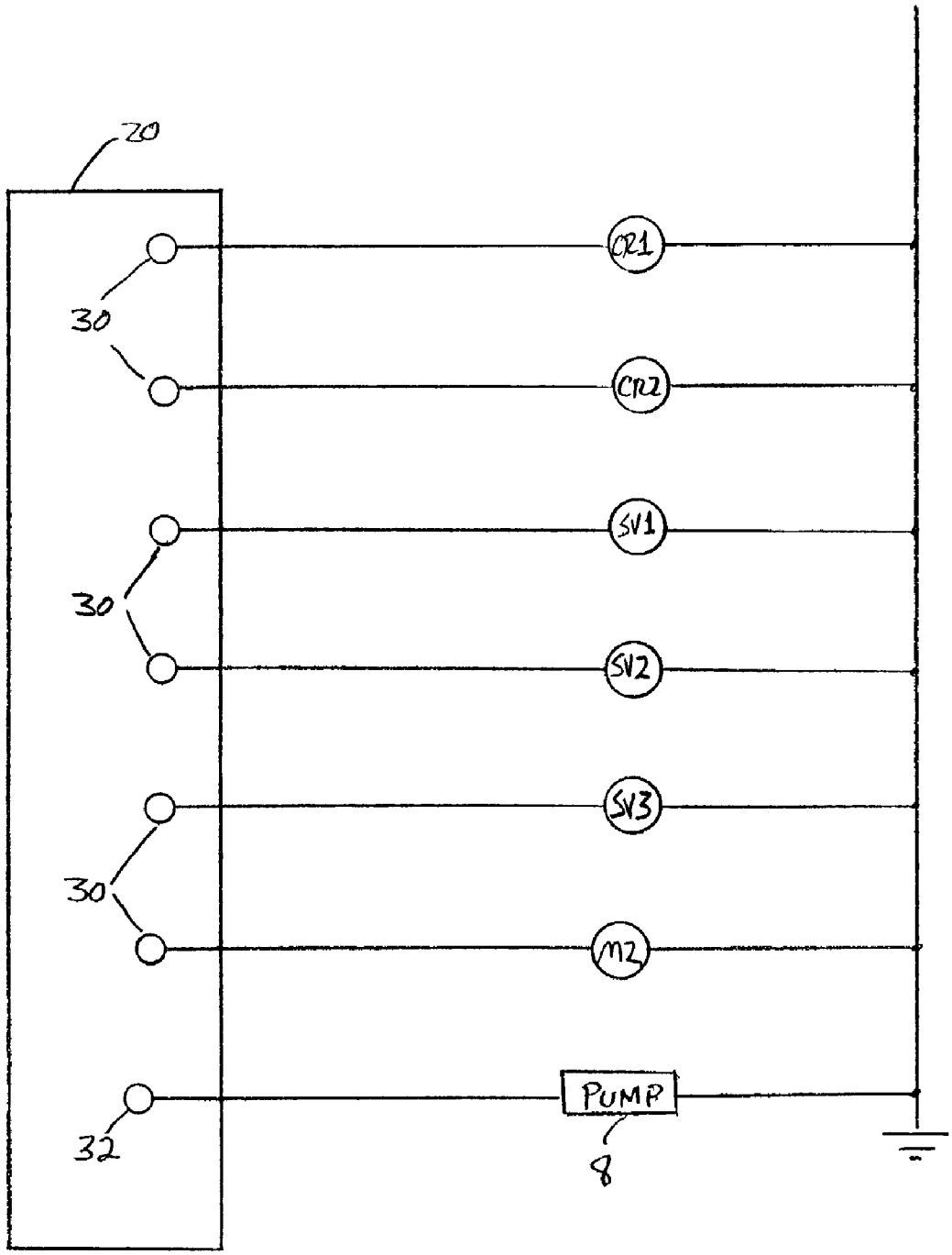
FIG. 2 is a wiring diagram of central computer outputs in accordance with the invention.
Figure 3:
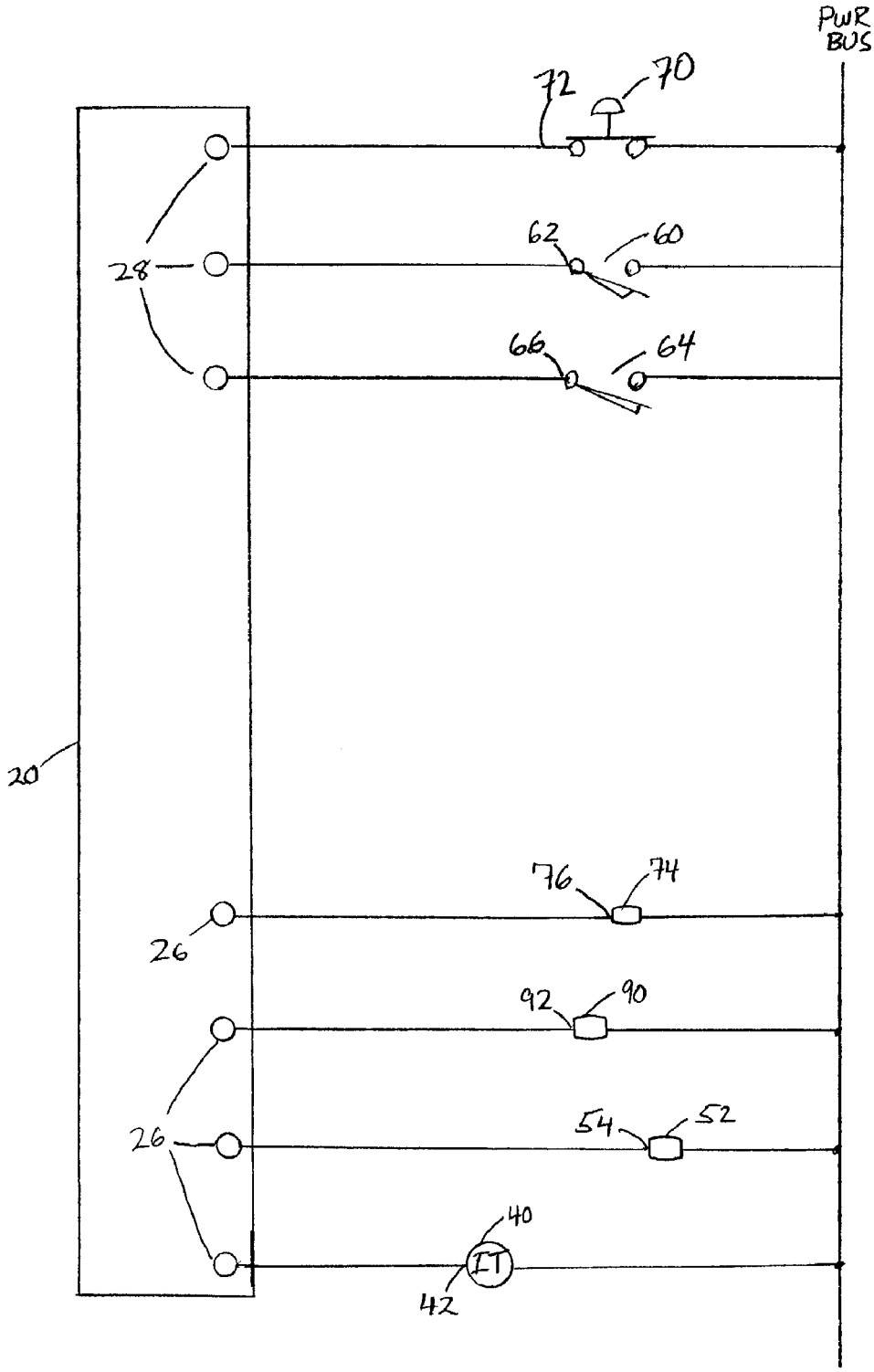
FIG. 3 is a wiring diagram of central computer analog and digital inputs in accordance with the invention.

Referring now to drawing FIGS. 1,2 and 3 in a preferred constructed embodiment of the invention a control system 10 for a rotary grinder 1 having a cylindrical rotor 2 that is capable of rotation in both the clockwise and counterclockwise directions (or alternatively, forward and reverse) and a ram 5 that is capable of forward and backward motion (both towards and away from said rotor 2) comprises a central computer 20 having a plurality of analog and digital inputs and outputs and a plurality of sensors electrically connected thereto for controlling the grinder 1, as will be explained further below. A material to be ground 6 is fed into a space 9 between the rotor 2 and ram 5 from a hopper or bin prior to beginning the grinding operation.

The central computer 20 may be a conventional microcomputer having a processor 22 and a memory 24 associated therewith. The central computer 20 provides a plurality of both analog and digital inputs 26 and 28 respectively that accept a plurality of input signals and a plurality of digital outputs 30 for operating various system 10 devices. In one embodiment of the invention a programmable logic controller (PLC) may be employed as a central computer 20. Many varieties of programmable logic controllers are manufactured by, for example, Allen-Bradley®, GE Fanuc®, Texas Instruments®, or Siemens®, although any computer capable of accepting and producing the various inputs and outputs required for the system 10 and execute logic instructions placed in memory 24 may be employed as a central computer 20.

The rotor 2 is driven by an electric motor 3 that is capable of operation in both the counterclockwise and clockwise directions. The motor 3 is controlled by a plurality of outputs 30 that energize a forward control relay CR1 or a reverse control relay CR2 that subsequently provide power to operate the motor in the forward and reverse directions via a motor control center (not shown) and a contactor mounted therein as is well known to one of ordinary skill in the art.

The power being supplied to the rotor 2 motor 3 is monitored with a current transmitter 40 having an output 42 representative of electrical current being supplied to the motor 3. The current transmitter 40 output 42 is connected to an analog input 26 of the central computer 20 so that the computer 20 can monitor the electrical current being supplied to the rotor motor 3. Many current transmitters 40 are equipped with induction coils that are placed around the power wiring, or a phase thereof, supplying electrical power to the motor 3, whereby a voltage representative of motor 3 current is induced in the coil thereby providing an output 42 representative of the power being used by the motor. Alternatively, a conventional power meter having an analog output representative of power consumed by the motor 3 may be employed in place of the current transmitter 40.

The ram 5 is moved forward and backwards toward and away from the rotor 2 by a conventional hydraulic cylinder 7 and piston that is supplied with hydraulic fluid pressurized by a pump 8. A hydraulic fluid line 50 used to supply pressurized hydraulic fluid to the cylinder 7 is equipped with a conventional pressure sensor 52 having an analog output 54 representative of the pressure of the hydraulic fluid in the line 50 proximate the sensor 52. The pressure sensor output 54 is connected to an analog input 26 whereby the central computer monitors the hydraulic pressure output signal being supplied to the ram 5. The pressure sensed by the pressure sensor 52 is representative of the pressure being delivered to the material 6 by the ram 5. As an alternative to the pressure sensor 52, a conventional load cell having an output representative of the force being exerted by the ram 5 may be affixed thereto.

The control system 10 of the present invention further comprises front and rear ram travel limit switches 60 and 64 respectively. The front limit switch 60 is positioned at the point of farthest travel of the ram 5, that is, at the point of travel when the ram 5 is nearest the rotor 2. In contradistinction, the rear limit switch 64 is positioned at the point of travel of the ram 5 farthest away from the rotor 2. Both limit switches are located such that the ram makes contact with the switch proximate its furthest point of travel in either direction. Both the front 60 and rear 64 limit switches have conventional digital outputs 62 and 66 respectively, wired to the digital inputs 28 of the central computer 20. The front 60 and rear 64 limit switches are used by the central computer 20 to determine when the ram 5 has reached the end of its range of travel and thereby stop and/or reverse it.

A linear displacement transducer 74 having an output 76 that is representative of ram 5 position may be employed to provide a continuous indication ram 5 position to the central computer 20 via an input 26. The linear displacement transducer 74 is typically mounted such that it monitors the motion of the ram 5. This embodiment of the present invention permits the central computer 20 to determine the exact ram 5 position at any time during the grinding process.

The central computer 20 further utilizes a plurality of outputs 30 to control and activate various system 10 components. Rotor forward and rotor reverse outputs 30 are supplied to a conventional motor control center (not shown) to energize the forward and reverse control relays CR1 and CR2, which in turn supply power to the rotor 2 motor 3 in the forward or reverse directions through a contactor in the motor control center. The outputs 30 are turned "on" responsive to software logic programmed in the memory of the central computer 20, as discussed further below.

The central computer 20 provides output 30 that energizes a control relay M2 providing electrical power to the hydraulic pump 8, as is well known to one of ordinary skill in the art. Furthermore, the central computer 20 provides a plurality of outputs 30 to energize a plurality of solenoid valves SV1, SV2, and SV3 respectively, which route hydraulic fluid to the cylinder 6 to move the ram 5 forward slowly, forward fast, and reverse, depending upon which output is activated.

In another embodiment of the present invention the hydraulic pump 8 is a wobble plate type pump or equivalent variable flow hydraulic pump that accepts an analog output 32 from the central computer 20 representative of a desired flow rate as a pump 8 control signal. The pump 8 then supplies variable flow hydraulic fluid to the cylinder 7 to control the velocity of the ram 5 motion responsive to the output 32. This feature of the invention permits an operator to select a variable ram 5 speed by controlling the pump 8 instead of just the solenoid valves based upon the physical characteristics of the material to be ground.

The following method of operating the grinding system of the present invention is implemented by supplying suitable logic programming to the central computer 20, as is well known to one of ordinary skill in the art. The central computer 20 thence activates or de-activates outputs 30 based upon the logic operations performed by the computer 20 as it executes the programming instructions. In operation, the grinding process is usually initiated with the ram 5 located in the rear-most position farthest away from the rotor 2, with the rotor 2 stopped. An operator may initiate the grinding process by pulling out (or de-selecting) an emergency stop (e-stop) push-button 70 that is connected to an input 28 of the central computer 20.

Once the e-stop 70 input is removed, the central computer 20 starts the rotor 2 motor 3 by turning on the output corresponding to the rotor 2 forward control relay CR1. The central computer 20 initiates a time delay for a predetermined amount of time prior to initiating the forward motion of the ram 5 to avoid forcing material to be ground into the rotor 2 until it reaches its operating rotating speed. This time delay may be, for example, 5 seconds to allow the rotor 2 to attain its operating speed. Once this start-up time delay has elapsed, the central computer 20 activates the output 30 corresponding to the ram 5 fast forward solenoid valve SV2 to initiate forward motion of the ram 5, thereby forcing material into the rotor 2 to be ground. Once the ram 5 reaches its forward-most point (prior to contacting the rotor 2) it contacts the limit switch 64, which provides an output 66 to an input 28 of the central computer 20 indicating the ram 5 has attained its furthest forward position.

When this forward limit switch 64 input 66 is received, the central computer 20 de-energizes the ram 5 fast forward solenoid valve SV2, and energizes the ram reverse solenoid valve SV3, thereby causing the ram to travel away from the rotor 2.

In another feature of the invention, when the ram 5 is traveling in either direction and the pressure sensor 52 analog output 54 is received by an analog input 26 of the central computer 20 that is representative of a hydraulic pressure higher than a predetermined threshold level the central computer 20 reverses the direction of ram 5 as discussed above. This high hydraulic pressure level is a strong indication that the rotor 2 is not grinding material quickly enough whereupon the ram 5 attempts to force material into the rotor 2. Once the reversing ram 5 reaches the rear limit switch 60 the central computer 20 again reverses the ram 5 direction by de-energizing the reverse solenoid valve SV3, and energizing the forward solenoid valve SV2. This feature of the present invention prevents the ram 5 from moving forward if an excess of material is impacting on the rotor 2 regardless of rotor 2 current levels, thereby preventing the material from heating up due to increased friction, and potentially melting. This feature of the present invention is particularly advantageous when grinding certain types of plastics having low melting points since the threshold pressure level can be reduced accordingly.

The central computer 20 continuously monitors the output 42 of the current transmitter 40 to determine whether the rotor 2 motor 2 is drawing excess current, thereby indicating reduced efficiency grinder operation and potential damage to mechanical and electrical grinder system components. When the current transmitter 40 output 42 is greater than a predetermined overcurrent threshold I for a predetermined time period as determined by the central computer 20 reading an analog input 26 connected to the output 42, the central computer 20 enters over-current mode operation, performing the following sequence of events designed to reduce the force of the material impinging upon the rotor 2 and thereby permitting the rotor 2 to "clear" itself.

Initially, the central computer 20 stops the forward motion of the ram 5, by de-energizing the ram forward solenoid valve SV2. The central computer 20 then stops the rotor 2 by de-energizing the motor 3 control relay CR1. After a predetermined period of time has elapsed to allow the spinning rotor 2 to cease its forward rotation, the central computer 20 then energizes the rotor 2 reverse control relay CR2 thereby spinning the rotor 2 in the reverse direction.

Thus when an over-current event is detected by the central computer 20, the forward motion of the ram 5 is stopped, and the rotor 2 is reversed to allow the loosening and clearing of impacted material impinging against the motion of the rotor 2. The time delay used in the central computer 20 prior to reversing the rotor is necessary to avoid undue stress on the rotor 2 and motor 3 caused by attempting to overcome the inertia of the spinning rotor 2 by starting it in the opposite direction too quickly.

In one embodiment of the invention, the central computer 20 initiates the over-current mode operation described herein above if a motor current of 150% full load amperes (FLA) is detected for more than 1.5 seconds. The magnitude and duration of motor 3 over-current required to initiate over-current mode operation may be modified to suit the electrical characteristics particular motor 3 and the material being ground.

In another embodiment of the invention 10, the magnitude and duration of motor 3 over-current required to initiate the aforementioned sequence of events may be selected by an operator by the use of an operator interface 80 that communicates with the central computer 20 and is used to display grinding operation variables and communicates with the central computer 20. In this embodiment of the invention the operator may set an amount of over-current, for example, 110%, 120%, or 150% of full load motor amperes, and the time duration of the specified over-current required to initiate over-current mode operation. The operator may also use the interface 80 to set each of the threshold parameters used in the grinding operation, for example ram forward speed, ram reverse speed, and maximum ram pressure. An example of an operator interface 80 that may be employed with the instant invention is a programmable PanelView® manufactured by Allen-Bradley®.

In one embodiment of the present invention the central computer 20 continuously monitors the output 42 of the current sensor 40 to determine when the current being supplied to rotor 2 exceeds a predetermined threshold level indicating that the rotor 2 is beginning to perform an amount of work that leads to increasing levels of friction (and therefore heat) in the material being ground. Once this current threshold is reached, it becomes increasingly likely that an over-current event will eventually result, causing the system to operate in over-current mode and the grinding process to halt while the rotor "clears" itself as discussed herein above. Accordingly, upon sensing the predetermined current threshold from the current sensor 40, the central computer 20 reverses the direction of the ram 5 by energizing the appropriate solenoid valve SV3 for a predetermined time period, Trev. The ram 5 thus reverses direction for the time period indicated by Trev. This reversal of the ram 5 continues for the entire time period Trev unless the ram 5 contacts a forward or reverse limit switch 64 or 60 respectively.

Once the predetermined time period Trev has expired, the central computer 20 energizes the forward slow solenoid valve SV1 to begin moving the ram 5 in its original direction. This feature of the present invention permits the central computer 20 to detect potential high motor 3 current events prior to their occurrence, and reduce the amount of material being forced towards the rotor 2. The current threshold at which the above sequence is initiated may be, for example, 60, 80 or 100 percent of full load amperes for the motor 3. Furthermore, this current threshold may be operator selectable through the use of the operator interface 80 based on the characteristics of the material being ground such as melting point, abrasiveness, etc.

In another embodiment of the present invention, upon initiation of the grinding process the central computer 20 delays the forward movement of the ram 5 for a brief time period, for example 10 seconds, to permit the rotor 2 to attain its operating rotational velocity prior to grinding material.

As long as no current threshold level is exceeded or overcurrent event is detected by the central computer 20 the ram 5 will advance in a forward direction towards the rotor 2 until the front limit switch 64 is reached, whereupon the ram 5 is reversed by the central computer 20 (the fast or slow forward solenoid valve SV2 or SV1 is de-energized and the reverse solenoid valve SV3 is energized). The ram 5 then travels away from the rotor 2 until it reaches the rear limit switch 60, whereupon the central computer 20 receives the rear limit switch output 62, and reverses the ram 5 direction to forward again. The material to be ground is generally gravity-fed from a hopper located above the ram 5 into the space between the ram 5 and the rotor 2. This reversing action permits material to drop in front of the ram 5 where it is then forced towards and into the rotor 2.

In another embodiment of the present invention, rather than returning to the rear limit switch 60 after reversing direction at the forward limit switch 64, the ram 5 travels in the reverse direction away from the rotor 2 for a predetermined period of time, thence reverses direction to travel forward towards the rotor 2 again. Thus the ram 5 travels a shortened stroke that permits an additional portion of material to be placed in front of the ram 5. During this "short stroke" operation the grinder operator may select the time period of reverse travel for the ram 5, using the operator interface 80, which time may be dependent upon the characteristics of the material being ground.

In a further embodiment of the present invention a conventional resolver 90 having an output 92 may be used to determine the position of the ram 5 with respect to the rotor 2, rather than rely on the limit switches 60 and 64. Accordingly, the resolver output 92 will indicate the far forward and reverse points of ram 5 travel to the central computer 20 via an analog input 26. Additionally, where the linear displacement transducer 74 is employed, the output 76 provides to the central computer 20 the exact ram 5 position.

Where the wobble-plate (variable-flow) pump 8 is employed, an operator may select the speed of ram 5 movement in both the forward and reverse directions by using the operator interface 80 to enter both forward and reverse speed limits, typically defined as a percentage of the maximum ram speed attainable given the flow characteristics of the pump 8 and cylinder 7. This permits the system 10 to control both ram 5 speed and pressure, thereby permitting efficient grinding of a wide variety of materials. Since some materials are more efficiently ground using a more quickly advancing ram, this feature permits an operator to tailor the ram 5 speed to the physical characteristics of the material to be ground.

The foregoing detailed description is given primarily for clearness of understanding and no unnecessary limitations are to be understood therefrom for modifications will become obvious to those skilled in the art upon reading this disclosure and may be made without departing from the spirit of the invention.

I claim:

1. A control system for a grinder having a motor-driven rotor for grinding a material and a reversible hydraulic ram for feeding said material towards said rotor, comprising:

a central computer having a processor, a memory associated therewith, and a plurality of inputs and outputs;

a linear displacement transducer having an output representative of the position of said ram connected to an input of said central computer for detecting the position of said ram;

a current transmitter having an output representative of the electrical current being supplied to the motor of said rotor connected to an input of said central computer;

a pressure sensor having an output representative of the pressure being exerted by said ram on the material connected to an input of said control computer;

a variable flow hydraulic pump for pressurizing hydraulic fluid;

a plurality of solenoid valves for supplying hydraulic fluid to said ram thereby forcing said ram towards or away from said rotor, or stopping said ram, said plurality of solenoid valves connected to and energized by a plurality of outputs; and wherein said central computer controls both the direction and maximum velocity of said ram during its forward and reverse travel responsive to the electrical current being supplied to said rotor motor and the pressure being exerted by said ram.

2. A control system for a grinder as claimed in claim 1 wherein the maximum velocity of said ram during its forward and reverse travel is selectable by a grinder operator.

3. The control system for a grinder of claim 1, further comprising:

a ram forward limit switch for detecting a farthest forward position of said ram having an output connected to an input of said central computer; and, a ram reverse limit switch for detecting a beginning position for said ram having an output connected to an input of said central computer.

4. A control system for a grinder as claimed in claim 1 further comprising:

an operator interface communicating with said central computer to permit an operator to control said system.

5. A control system for a grinder as claimed in claim 1 wherein said central computer is a programmable logic controller.

6. A control system for a grinder as claimed in claim 1 wherein a plurality of outputs of said central computer control the rotational direction of said rotor motor responsive to the electrical current being supplied thereto.

* * * * *